United States Patent [19]

Sato

[11] Patent Number: 4,767,342

[45] Date of Patent: Aug. 30, 1988

[54] ELECTRICAL CONNECTOR FOR PRINTED CIRCUIT BOARD

[75] Inventor: Kensaku Sato, Tokyo, Japan

[73] Assignee: Hirose Electric Co., Ltd., Tokyo, Japan

[21] Appl. No.: 129,305

[22] Filed: Dec. 7, 1987

[51] Int. Cl.[4] ..... H01R 9/09

[52] U.S. Cl. ..... 439/78; 439/80; 439/83

[58] Field of Search ..... 439/76, 78, 80–83, 439/603, 888

[56] References Cited

U.S. PATENT DOCUMENTS

| | | | |
|---|---|---|---|
| 2,958,065 | 10/1960 | Flanagan et al. | 439/80 |
| 3,697,933 | 10/1972 | Black et al. | 439/80 |
| 4,003,617 | 1/1977 | Witek, Jr. et al. | 439/80 |
| 4,342,495 | 8/1982 | Bennett et al. | 339/163 |
| 4,671,584 | 6/1987 | Barkus et al. | 439/78 |
| 4,693,528 | 9/1987 | Asick et al. | 439/83 |
| 4,709,973 | 12/1987 | Waters et al. | 439/78 |

FOREIGN PATENT DOCUMENTS 54-60285 4/1979 Japan .

*Primary Examiner*—Gil Weidenfeld
*Assistant Examiner*—Paula A. Austin
*Attorney, Agent, or Firm*—Takeuchi Patent Office

[57] ABSTRACT

An electrical connector for a printed circuit board consisting of a housing having a body section with a plurality of receiving apertures and a depending post section, and a plurality of female contacts fitted in the receiving aperture and capable of receiving a male contact in either front or rear opening. The female contact has an elongated wiring section which fits in the longitudinal groove and a lateral slot provided in the post section, thus providing female contacts free of a flux deposit and firmly retained in the housing.

4 Claims, 2 Drawing Sheets

ELECTRICAL CONNECTOR FOR PRINTED CIRCUIT BOARD

BACKGROUND OF THE INVENTION

The present invenion relates generally to electrical connectors and, more particularly, to an electrical connector for printed circuit board (PCB) which has at least two openings one for each direction for receiving a male contact of a mating connector.

It is desirable to mount an electrical connector on a PCB in such a manner that the whole equipment may be compact or the connector may be able to receive a mating connector in different directions. Japanese Patent Kokai No. 54-60285 discloses such an electrical connector. This electrical connector has a rectangular housing with a plurality of receiving apertures for holding female contacts. Each female contact has been formed in such a manner that it may receive a male contact through either upper or lower end of the contacting section. A wiring section extends from a lower end of the contacting section first horizontally and then downwardly. The horizontal wiring portion is received by a horizontal groove provided on the bottom of the housing and the downward portion projects normally to the horizontal groove for soldering to a printed circuit board.

In the above connector, however, the horizontal groove for the horizonatal wiring portion is formed in the direction of a housing thickness so that it cannot help being short. In addition, the wiring section is bent midway in the horizontal groove so that the length held in the horizontal groove is very short. Consequently, when the PCB is dipped in a flux bath, the flux flows through the plated through hole (PTH) along the wiring section to the contacting section of a female contact. For this reason, the gripping force of the contacting section decreases as the thickness of the flux increases, thus failing to provide a predetermined gripping force. The contacting surface covered with the flux causes poor contact. In a solder flow at high temperatures, the flux adhering to the wiring section and the PCB backside becomes gaseous and enters the horizontal groove through the PTH and even the receiving aperture for reciving a male contact and the contacting section of a female contact, depositing there as it cools. This deposit makes a connection with a male contact poor and electrical continuity interrupted.

SUMMARY OF THE INVENTION

Accordingly, it is an object of the invention to provide a PCB electrical connector having a plurality of female contacts free of a flux deposit in the contacting section after soldering.

It is another object of the invention to provide a PCB electrical connector which ensures firmer retention of female contacts in the housing.

It is still another object of the invention to provide a PCB electrical connector which is free of damage to the female contact caused by the insertion of a male contact.

According to one aspect of the invention there is provided an electrical connector for a printed circuit board, which comprises a housing having a body section and a post section extending downwardly from a rear end of the body section to form a L-shaped cross-section; the body section having a plurality of receiving apertures with front and rear openings and a bottom cut along its length; the post section having a longitudinal groove communicating with the bottom cut at its upper end; a plurality of female contacts each fitted into each of the receiving apertures and having openings at opposite ends, either of which is able to receive a male contact; each of the female contact having a contacting section received in the receiving aperture and a wiring section extending downwardly from the contacting section so as to fit into the longitudinal groove; and a free end of the wiring section projecting from the post section for soldering to a printed circuit of the printed circuit board.

With the above structure, the longitudinal groove can be sufficiently long to allow a long wiring portion of a female contact to prevent the flux from reaching the contacting section. In addition, the long wiring portion ensures firmer retention of the female contact within the housing.

According to another aspect of the invention, there are provided a plurality of lateral slots in the post section so that the wiring portion may project through a desired PTH.

According to still another aspect of the invention, the female contact has a pair of spring contacting tongues and a protecting portion for guiding a male contact into the contacting tongues, thereby protecting the contacting tongues against damage caused by the insertion of a male contact.

Other objects, features, and advantages of the invention will be apparent from the following description when taken in conjunction with the accompanying drawings.

DESCRIPTION OF THE PREFERRED EMBODIMENTS

Figure 1:
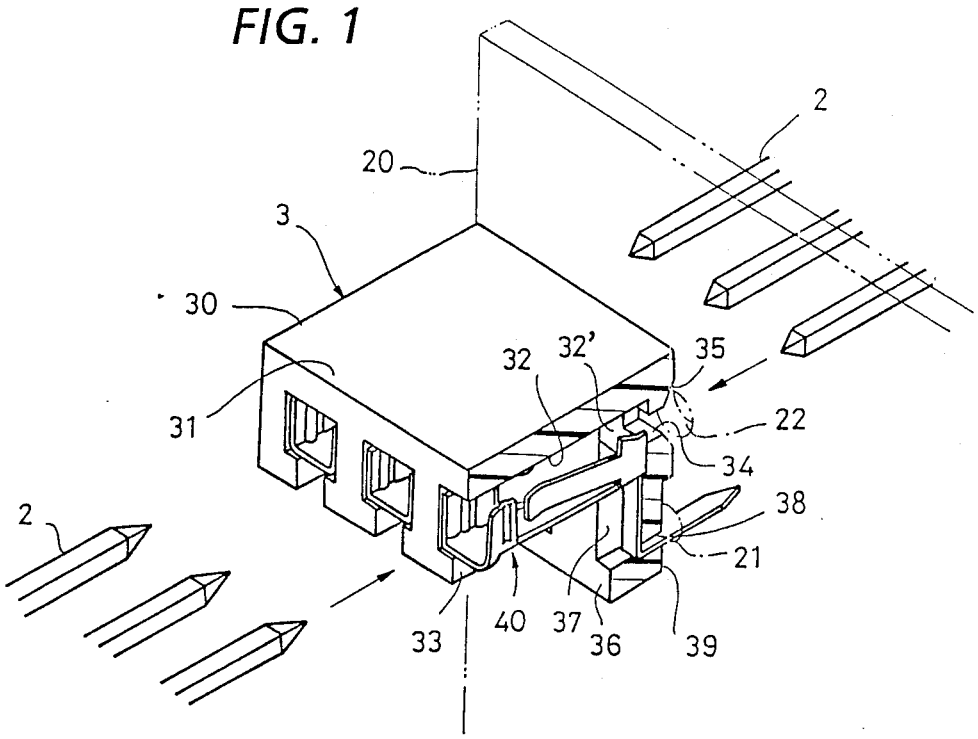
FIG. 1 is a perspective, partially sectional, view of a PCB electrical connector according to an embodiment of the invention.

FIG. 1 shows a PCB electrical connector 3 according to an embodiment of the invention. The connector 3 consists of a housing 30 molded of an insulating material so as to have a plurality of receiving apertures 32 and a plurality of female contacts 40 each made of a resilient metal sheet in such a manner that it may fit into the aperture. The housing 30 has a body section 31 and a post section 36 which is intergral with the body section at right angles to form a generally L-shaped cross-section.

Each receiving aperture 32 has a bottom cut 33 along its length, the width of which is smaller than that of the receiving aperture. The receiving aperture 32 has at the rear end a guide opening 34 with a tapered portion 35 for easy insertion of the male contact 2 of a mating connector. The post section 36 has a longitudial groove 37 and a lateral slot 38 for receiving an intermediate portion 47 and a wiring portion 48, respectively, of the female contact 40. The longitudinal groove 37 communicates with the bottom cut 33 at its upper end. The post section 36 further has a longitudianal indentation 39 on the back side opposite to the longitudinal groove 37.

Figure 2:
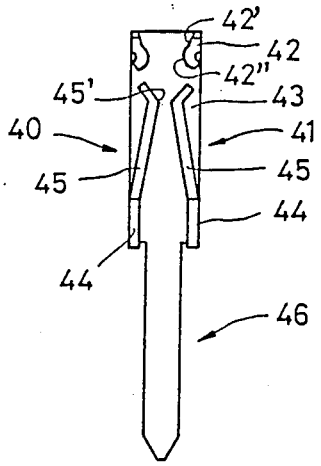
FIGS. 2 and 3 are top and side views of a female contact useful for the electrical connector of FIG. 1.
Figure 3:
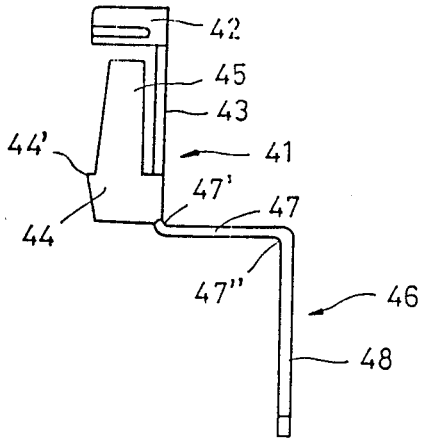

FIGS. 2 and 3 show a female contact useful for the electrical contact of FIG. 1. It has a contacting head secton 41 and a wiring tail section 46. The contacting head 41 has a generally U-shaped cross-section protecting portion 42 with a tapered portion 42' made with an embossment 42'' for easy insertion of the male contact 2 of a mating connector, thus protecting the contacting tongues from damage. This embossment 42'' also serves to reinforce the protector 42 which is integral with a base plate 43 provided with a generally U-shaped cross section base portion 44. A pair of spring contacting tongues 45 extends from the base portion 44 toward the protector 42 and are bent first inwardly and then outwardly, forming a throat portion 45'. The base portion 44 has a pair of barbs 44' for engaging the ceiling of the aperture, thus preventing the female contact 40 from falling off the receiving aperture 32. The wiring section 46 has the intermediate portion 47 bent at right angles at 47' to the base plate 43 and the wiring portion 48 bent at right angles at 47'' to the intermediate portion 47 so as to be parallel to the base plate 43.

The housing 30 and female contacts 40 are assembled as follows.

(1) The base portion 44 of a female contact 40 is inserted into a receiving aperture 32 in such a manner that the wiring section 46 may be in registration with the bottom cut 33.

(2) The wiring portion 48 is inserted into the lateral slot 38 and the intermediate portion in fitted into the longitudinal groove 37 of the post section 36 until the back of the base portion 44 abuts the end wall 32' of the receiving aperture 32. By this point, the barbs 44' of the base portion 44 have engaged the ceiling of the receiving aperture 32, thus preventing the contact 40 from falling off from the receiving aperture.

The thus assembled connector 3 is mounted on a PCB 20 in so that the wiring portion 48 is inserted into a PTH 21 for soldering and the guide opening 34 is in registration with a hole 22 through which the male contact of a mating connector is inserted. The male contact may be connected to the female contact from either front or rear end, thus making the electrical connector more adaptable.

Figure 4:
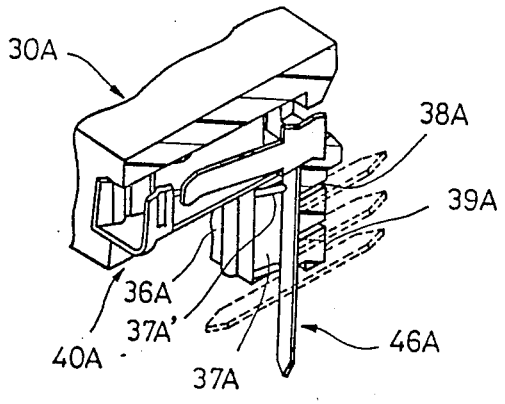
FIG. 4 is a perspective, partially sectional, view of a PCB electrical connector according to another embodiment of the invention.

FIG. 4 shows an electical connector according to another embodiment of the invention. The post section 36A of a housing 30A is provided with a longitudinal groove 37A which extends up to the bottom of the post section. A pair of slant ribs 37A' are provided on opposite sides of the longitudinal groove 37A to retain the wiring section 46A of a contact 40A. A plurality of lateral slots 38A are provided across the longitudinal groove 37A and the indentation 39A so that the wiring section 46A may extend downwardly straight, or be bent rearwardly at right angles along the bottom or so as to fit into one of the slots. Also, it may be bent forwardly so as to fit into a PTH of a PCB which is provided in front of the connector. Thus, the direction of the wiring section 46A may be changed as occasion demands, In addition, the gripping force on the wiring section 46A is improved.

According to the invention, the wiring section of a female contact is so long without reducing the gripping force that no flux reaches the contacting section of a female contact upon soldering, thus eliminating poor contact and interruption of the electrical continuity due to the flux deposit. The lateral slot of the post section makes it possible not only to change the direction in which the wiring section extends but also to improve the gripping force. The provision of a plurality of slots gives more freedom in design of the wiring section to meet various requirements. The protecting section ensures protection of the contacting tongues against damage which can be caused by insertion and removal operation of a male contact, thus reducing the possibility of malfunction.

While a preferred embodiment of the invention has been described using specific terms, such description is for illustrative purposes only, and it is to be understood that changes and variations may be made without departing from the spirit and scope of the invention as recited in the appended claims.

What is claimed is:

1. An electrical connector for a printed circuit board, which comprises:

a housing having a body section and a post section extending downwardly from a rear end of said body section to form a L-shaped cross-section;

said body section having a plurality of receiving apertures with front and rear openings and a bottom cut along its length;

said post section having a longitudinal groove communicating with said bottom cut at its upper end;

a plurality of female contacts each fitted into each of said receiving apertures and having openings at opposite ends, either of which is able to receive a male contact;

each of said female contact having a contacting section received in said receiving aperture and a wiring section extending downwardly from said contacting section so as to fit into said longitudinal groove; and a free end of said wiring section projecting from said post section for soldering to a printed circuit of said printed circuit board.

2. The electrical connector of claim 1, wherein said post section has a lateral slot at an end of said longitudinal groove through which a rearwardly bent wiring portion of said wiring section may be inserted.

3. The electrical connector of claim 1, wherein said post section has a plurality of lateral slots from an end of said longitudinal groove so that a rearwardly bent wiring portion of said wiring section may be inserted into one of said lateral slots.

4. The electrical connector of claim 1, wherein said female contact has a pair of spring contacting tongues forming a throat portion at their free ends; and a protecting portion for guiding said male contact into said contacting tongues.

* * * * *